US007730951B2

(12) United States Patent
Surjaatmadja et al.

(10) Patent No.: US 7,730,951 B2
(45) Date of Patent: Jun. 8, 2010

(54) METHODS OF INITIATING INTERSECTING FRACTURES USING EXPLOSIVE AND CRYOGENIC MEANS

(75) Inventors: Jim Surjaatmadja, Duncan, OK (US); Stanley Stephenson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 56 days.

(21) Appl. No.: 12/121,430

(22) Filed: May 15, 2008

(65) Prior Publication Data

US 2009/0283260 A1 Nov. 19, 2009

(51) Int. Cl.
*E21B 43/263* (2006.01)

(52) U.S. Cl. ..... 166/308.1; 166/250.1

(58) Field of Classification Search ..... 166/308.1, 166/177.5, 250.1, 299
See application file for complete search history.

(56) References Cited

U.S. PATENT DOCUMENTS

| | | | | | |
|---|---|---|---|---|---|
| 2,758,653 | A * | 8/1956 | Desbrow | 175/50 |
| 3,062,286 | A * | 11/1962 | Wyllie | 166/308.1 |
| 3,537,529 | A * | 11/1970 | Timmerman | 166/271 |
| 3,933,205 | A * | 1/1976 | Kiel | 166/308.1 |
| 4,005,750 | A * | 2/1977 | Shuck | 166/308.1 |
| 4,050,529 | A * | 9/1977 | Tagirov et al. | 175/424 |
| 4,724,905 | A | 2/1988 | Uhri | 166/250 |
| 4,733,567 | A * | 3/1988 | Serata | 73/784 |
| 4,830,106 | A | 5/1989 | Uhri | 166/250 |
| 4,974,675 | A * | 12/1990 | Austin et al. | 166/250.1 |
| 5,111,881 | A * | 5/1992 | Soliman et al. | 166/250.1 |
| 5,494,103 | A * | 2/1996 | Surjaatmadja et al. | 166/222 |
| 5,499,678 | A * | 3/1996 | Surjaatmadja et al. | 166/298 |
| 5,765,642 | A | 6/1998 | Surjaatmadja | 166/297 |
| 6,782,947 | B2 * | 8/2004 | de Rouffignac et al. | 166/245 |
| 7,225,869 | B2 | 6/2007 | Willett et al. | 166/280.1 |
| 7,431,090 | B2 * | 10/2008 | Surjaatmadja et al. | 166/308.1 |
| 7,445,045 | B2 * | 11/2008 | East et al. | 166/308.1 |
| 2002/0125011 | A1 * | 9/2002 | Snider et al. | 166/297 |
| 2005/0121196 | A1 * | 6/2005 | East et al. | 166/308.1 |
| 2005/0211439 | A1 * | 9/2005 | Willett et al. | 166/308.1 |
| 2006/0185848 | A1 * | 8/2006 | Surjaatmadja et al. | 166/280.2 |

(Continued)

FOREIGN PATENT DOCUMENTS

EP 0 474 3530 A1 7/1991

OTHER PUBLICATIONS

SPE 103774, "Consideration for Future Stimulation Options Is Vital in Deciding Horizontal Well Drilling and Completion Schemes for Production Optimization", 2006.

(Continued)

*Primary Examiner*—Shane Bomar
(74) *Attorney, Agent, or Firm*—John W. Wustenberg; Baker Botts, LLP

(57) ABSTRACT

Methods and systems that utilize explosive and cryogenic means to establish fluid communication to areas away from the well bore walls are disclosed. A first fracture is induced in the subterranean formation. The first fracture is initiated at about a fracturing location and the initiation of the first fracture is characterized by a first orientation line. The first fracture temporarily alters a stress field in the subterranean formation. Explosives are then used to induce a second fracture in the subterranean formation. The second fracture is initiated at about the fracturing location and the initiation of the second fracture is characterized by a second orientation line. The first orientation line and the second orientation line have an angular disposition to each other.

18 Claims, 7 Drawing Sheets

U.S. PATENT DOCUMENTS

| | | | | |
|---|---|---|---|---|
| 2006/0185898 | A1* | 8/2006 | Seekford | 175/4.6 |
| 2006/0289167 | A1* | 12/2006 | Surjaatmadja et al. | 166/308.1 |
| 2008/0083531 | A1 | 4/2008 | Surjaatmadja | 166/250.1 |
| 2008/0083532 | A1 | 4/2008 | Surjaatmadja | 166/250.1 |
| 2008/0083538 | A1* | 4/2008 | Soliman | 166/308.1 |

OTHER PUBLICATIONS

Surjaatmadja, "Single Point of Initiation, Dual-Fracture Placement for Maximizing Well Production," Society of petroleum Engineers, SPE 107718, 2007.

Surjaatmadja, "The Important Second Fracture and Its Operational Placement for Maximizing Production," Society of Petroleum Engineers, SPE 107059, 2007.

Surjaatmadja, "The Mythical Second Fracture and Its Operational Placement for Maximizing Production," Society of Petroleum Engineers, SPE 106046, 2007.

Warpinski, Norman R. and Branagan, Paul T., "Altered Stress Fracturing", JPT (Sep. 1989), 990-97, 473-476, SPE 17533.

* cited by examiner

METHODS OF INITIATING INTERSECTING FRACTURES USING EXPLOSIVE AND CRYOGENIC MEANS

BACKGROUND

The present invention relates generally to methods and systems for inducing fractures in a subterranean formation and more particularly to methods and systems that utilize explosive and cryogenic means to establish fluid communication to areas away from the well bore walls.

Oil and gas wells often produce hydrocarbons from subterranean formations. Occasionally, it is desired to add additional fractures to an already-fractured subterranean formation. For example, additional fracturing may be desired for a previously producing well that has been damaged due to factors such as fine migration. Although the existing fracture may still exist, it is no longer effective, or is less effective. In such a situation, stress caused by the first fracture continues to exist, but it would not significantly contribute to production. In another example, multiple fractures may be desired to increase reservoir production. This scenario may be also used to improve sweep efficiency for enhanced recovery wells such as water flooding steam injection, etc. In yet another example, additional fractures may be created to inject with drill cuttings.

Conventional methods for initiating additional fractures typically induce the additional fractures with near-identical angular orientation to previous fractures. While such methods increase the number of locations for drainage into the well bore, they may not introduce new directions for hydrocarbons to flow into the well bore. Such conventional methods are generally used for placing additional fractures at the approximate same location after a very long production of the fracture or used for placing additional fractures in the well at that same time frame but far away from the location of the previous fracture (such as in a different zone in the well). Conventional methods may also not account for or, even more so, utilize stress alterations around existing fractures when inducing new fractures. Moreover, placing additional fractures that are located at the same location as the first will simply reopen the first fracture. Hence, conventional methods are usually applicable for refracturing after a long term well production (after it is depleted) or for fracturing in a completely different zone.

An improved method and system for inducing a first fracture having a first orientation and a second fracture having a second orientation is disclosed in U.S. application Ser. No. 11/545,749 ("'749 application") which is incorporated herein by reference in its entirety. In accordance with the invention disclosed in the '749 application, Pin-Point stimulation technologies such as hydrajetting operations are used to establish the first fracture, and after a short time delay, the Pin Point stimulation technology is used to establish fluid communication to areas which have been modified by a first fracture. Specifically, a first fracture is used to modify the local stresses to allow the subsequent second fracture in a direction different from the first fracture. In this manner, the second fracture will reach more productive regions in the formation. The Pin-Point stimulation technology was particularly selected because, as the first fracture starts to close, the stresses near the well bore quickly return to their original condition. This is caused by the fact that the fracture mouth is "dangling" or unsupported; thus stresses normalize quickly. Mere pressurization of the well bore such as by using conventional methods would just re-open this first fracture. Using the Pin-Point stimulation technology, a pressure point is created away from the well bore by reperforating using Bernoulli pressurization, thus reaching locations with modified stresses and hence capable of initiating the second fracture into a completely different direction.

One suitable hydrajetting method, introduced by Halliburton Energy Services, Inc., is known as the SURGIFRAC and is described in U.S. Pat. No. 5,765,642. The SURGIFRAC process may be particularly well suited for use along highly deviated portions of a well bore, where casing the well bore may be difficult and/or expensive. The SURGIFRAC hydrajetting technique makes possible the generation of one or more independent, single plane hydraulic fractures. Furthermore, even when highly deviated or horizontal wells are cased, hydrajetting the perforations and fractures in such wells generally results in a more effective fracturing method than using traditional perforation and fracturing techniques.

Another suitable hydrajetting method, introduced by Halliburton Energy Services, Inc., is known as the COBRAMAX-H and is described in U.S. Pat. No. 7,225,869. The COBRAMAX-H process may be particularly well suited for use along highly deviated portions of a well bore. The COBRAMAX-H technique makes possible the generation of one or more independent hydraulic fractures without the necessity of zone isolation, can be used to perforate and fracture in a single down hole trip, and may eliminate the need to set mechanical plugs through the use of a proppant slug.

However, Pin-Point stimulation techniques such as SURGIFRAC and COBRAMAX-H may not be appropriate in certain circumstances. For instance, the wait period for the requisite tools may be too long. As a result, the well operations may be delayed in order for the necessary tools to be prepared and delivered to the field.

FIGURES

Some specific example embodiments of the disclosure may be understood by referring, in part, to the following description and the accompanying drawings.

Figure 1:
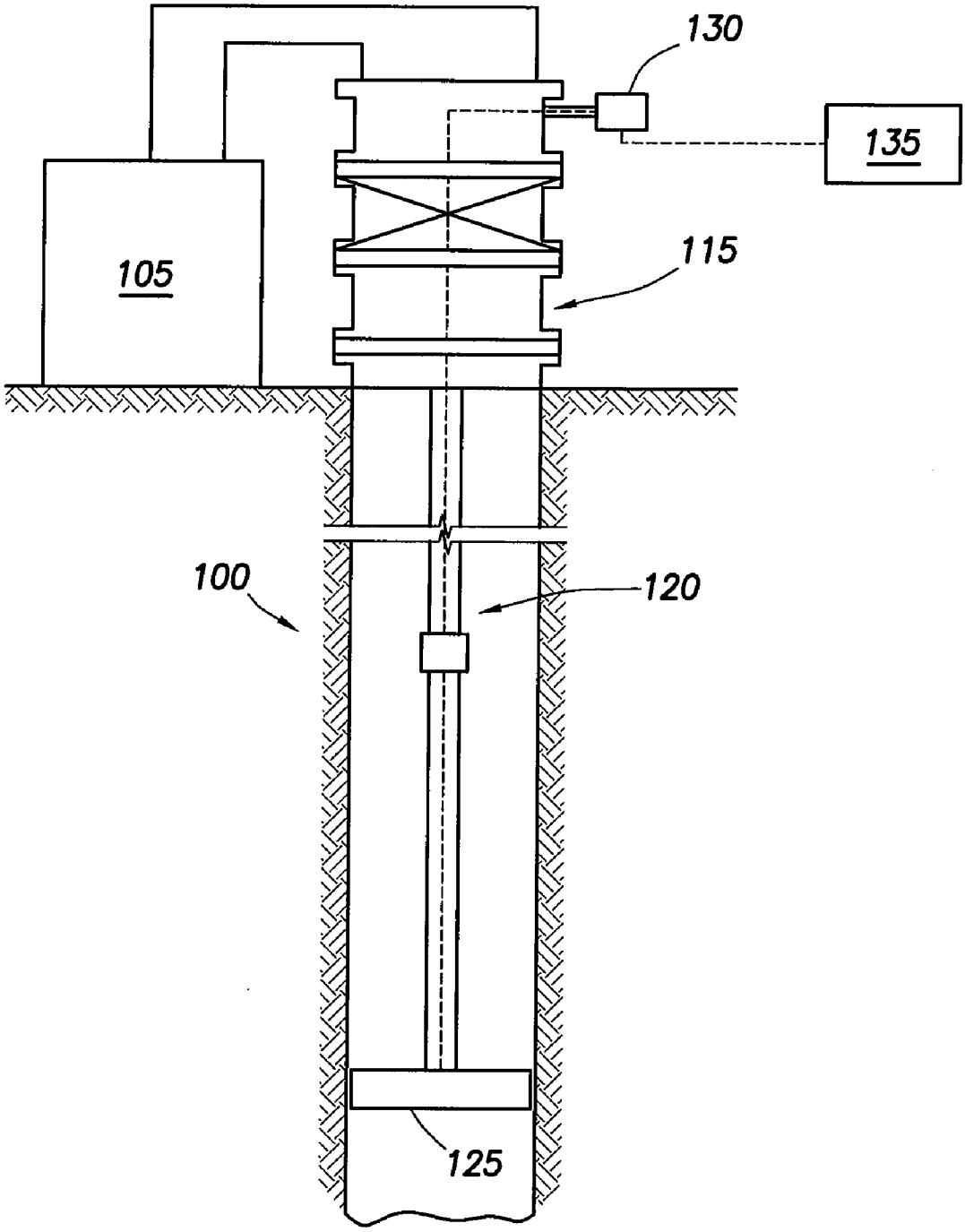
FIG. 1 is a schematic block diagram of a well bore and a system for fracturing.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

SUMMARY

The present invention relates generally to methods and systems for inducing fractures in a subterranean formation and more particularly to methods and systems that utilize explosive and cryogenic means to establish fluid communication to areas away from the well bore walls.

In one exemplary embodiment, the present invention is directed to a method for fracturing a subterranean formation, wherein the subterranean formation comprises a well bore having an axis, the method comprising: inducing a first fracture in the subterranean formation, wherein the first fracture is initiated at about a fracturing location, the initiation of the first fracture is characterized by a first orientation line and the first fracture temporarily alters a stress field in the subterranean formation; and using explosives to induce a second fracture in the subterranean formation, wherein the second fracture is initiated at about the fracturing location, the initiation of the second fracture is characterized by a second orientation line, and the first orientation line and the second orientation line have an angular disposition to each other.

In another exemplary embodiment, the present invention is directed to a system for fracturing a subterranean formation, wherein the subterranean formation comprises a well bore, the system comprising: a downhole conveyance selected from a group consisting of a drill string and coiled tubing, wherein the downhole conveyance is at least partially disposed in the well bore; a drive mechanism configured to move the downhole conveyance in the well bore; a pump coupled to the downhole conveyance to flow a combustible fluid mixture through the downhole conveyance; a fracturing tool coupled to the downhole conveyance, the fracturing tool comprising: a tool body to receive the combustible fluid mixture, the tool body comprising a plurality of fracturing sections, wherein each fracturing section includes at least one opening to deliver the combustible fluid mixture into the subterranean formation; and a computer configured to control the operation of the drive mechanism and the pump.

The features and advantages of the present disclosure will be readily apparent to those skilled in the art upon a reading of the description of exemplary embodiments, which follows.

DESCRIPTION

The present invention relates generally to methods and systems for inducing fractures in a subterranean formation and more particularly to methods and systems that utilize explosive and cryogenic means to establish fluid communication to areas away from the well bore walls.

The methods and systems of the present invention may allow for increased well productivity by the introduction of multiple fractures at different angles relative to one another in a well bore.

FIG. 1 depicts a schematic representation of a subterranean well bore 100 through which a fluid may be injected into a region of the subterranean formation surrounding well bore 100. The fluid may be of any composition suitable for the particular injection operation to be performed. For example, where the methods of the present invention are used in accordance with a fracture stimulation treatment, a fracturing fluid may be injected into a subterranean formation such that a fracture is created or extended in a region of the formation surrounding well bore 100. The fluid may be injected by an injection device 105 (e.g., a pump). At the wellhead 115, a downhole conveyance device 120 is used to deliver and position a fracturing tool 125 to a location in the well bore 100. In some example implementations, the downhole conveyance device 120 may include coiled tubing. In other example implementations, downhole conveyance device 120 may include a drill string that is capable of both moving the fracturing tool 125 along the well bore 100 and rotating the fracturing tool 125. The downhole conveyance device 120 may be driven by a drive mechanism 130. One or more sensors may be affixed to the downhole conveyance device 120 and configured to send signals to a control unit 135. The control unit 135 is coupled to drive mechanism 130 to control the operation of the drive unit. The control unit 135 is coupled to the injection device 105 to control the injection of fluid into the well bore 100. The control unit 135 includes one or more processors and associated data storage.

Figure 2A:
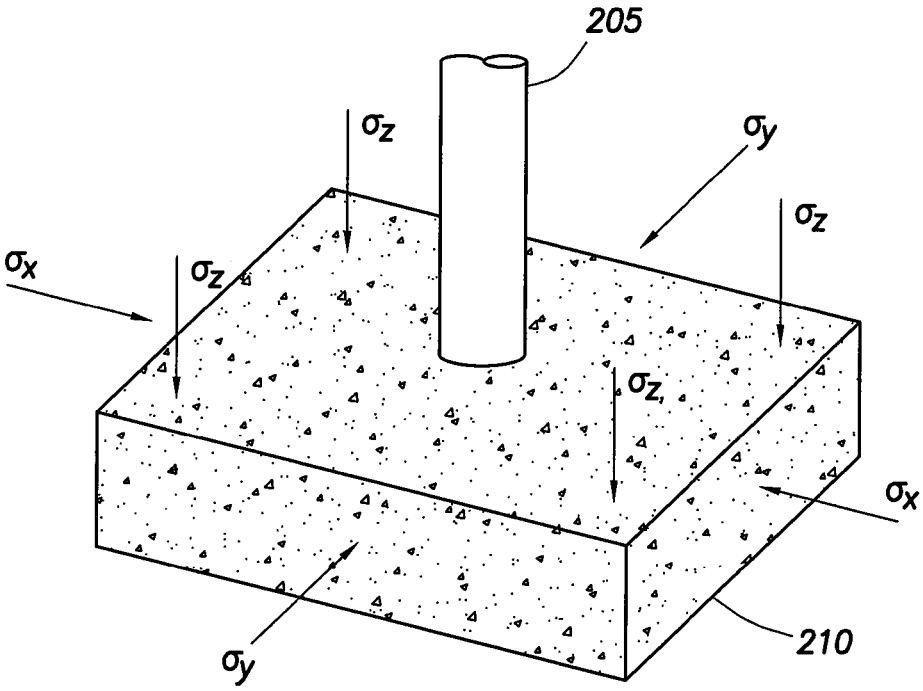
FIG. 2A is a graphical representation of a well bore in a subterranean formation and the principal stresses on the formation.

FIG. 2A is an illustration of a well bore 205 passing though a formation 210 and the stresses on the formation. In general, formation rock is subjected to the weight of anything above it, i.e. $\sigma_z$ overburden stresses. By Poisson's rule, these stresses and formation pressure effects translate into horizontal stresses $\sigma_x$ and $\sigma_y$. In general, however, Poisson's ratio is not consistent due to the randomness of the rock. Also, geological features, such as formation dipping may cause other stresses. Therefore, in most cases, $\sigma_x$ and $\sigma_y$ are different.

Figure 2B:
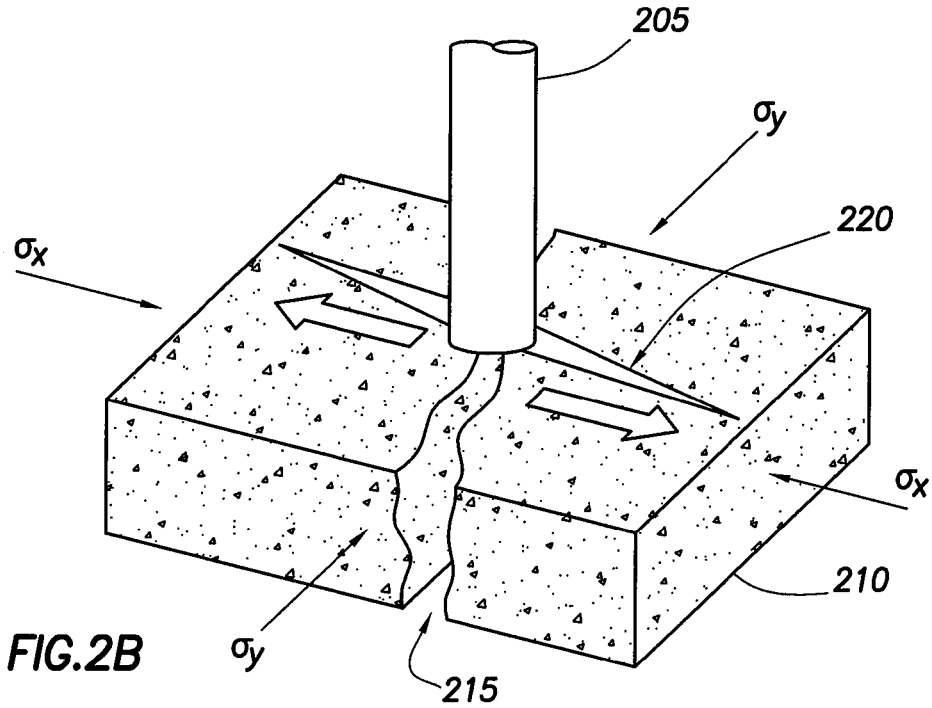
FIG. 2B is a graphical representation of a well bore in a subterranean formation that has been fractured and the principal stresses on the formation.

FIG. 2B is an illustration of the well bore 205 passing though the formation 210 after a first fracture 215 is induced in the formation 210. Assuming for this example that $\sigma_x$ is smaller than $\sigma_y$, the first fracture 215 will extend into the y direction. The orientation of the fracture is, however, in the x direction. As used herein, the orientation of a fracture is defined to be a vector perpendicular to the fracture plane.

As first fracture 215 opens, fracture faces are pushed in the x direction. Because formation boundaries cannot move, the rock becomes more compressed, increasing $\sigma_x$. Over time, the fracture will tend to close as the rock moves back to its original shape due to the increased $\sigma_x$. While the fracture is closing however, the stresses in the formation will cause a subsequent fracture to propagate in a new direction shown by a second fracture 220. The method and systems according to the present invention are directed to initiating fractures, such as a second fracture 220, while the stress field in the formation 210 is temporarily altered by an earlier fracture, such as first fracture 215.

Figure 3:
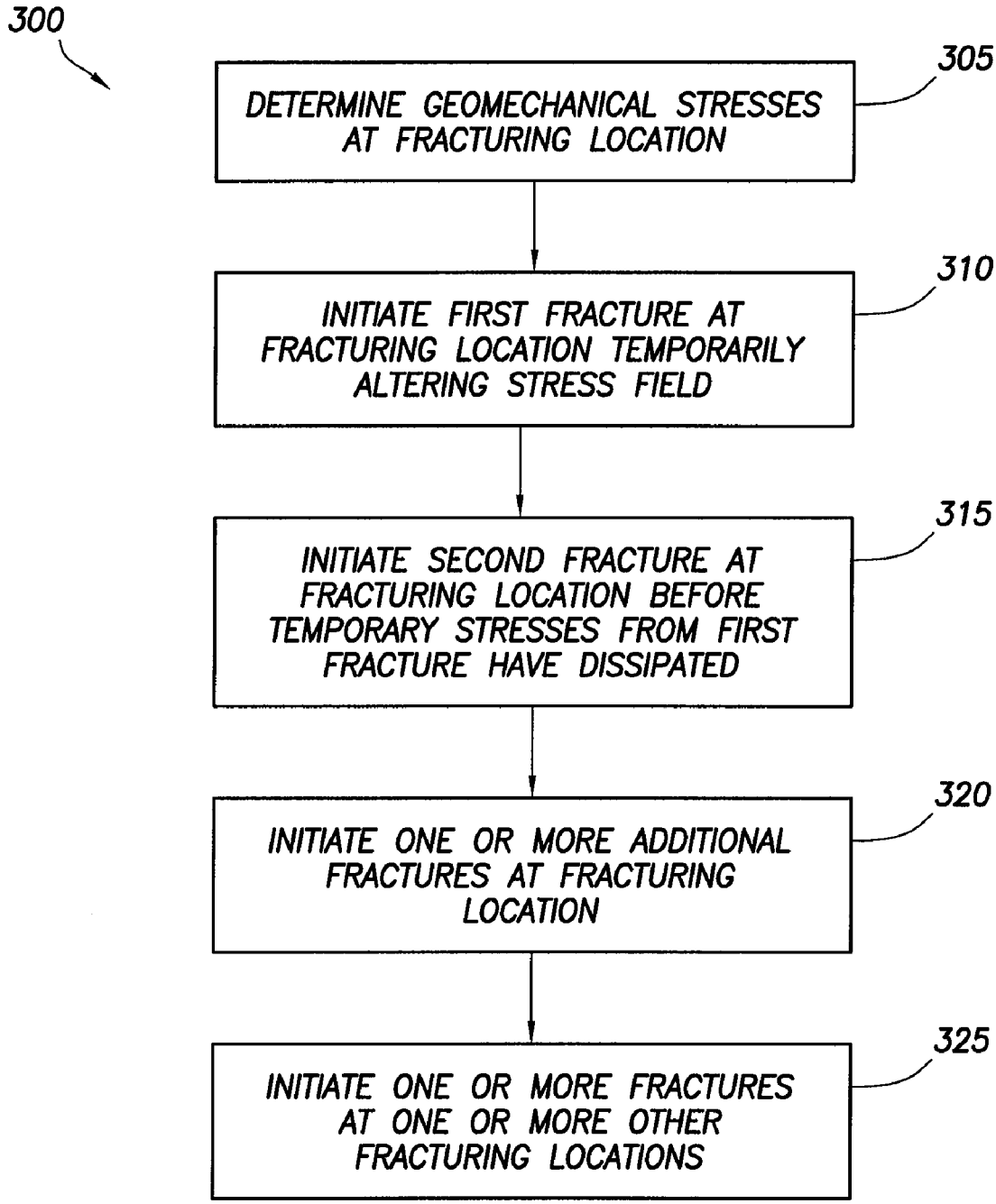
FIG. 3 is a flow chart illustrating an example method for fracturing a formation using the present invention.

FIG. 3 is a flow chart illustration of an example implementation of one method of the present invention, shown generally at 300. The method includes determining one or more geomechanical stresses at a fracturing location in step 305. In some implementations, step 305 may be omitted. In some implementations, this step includes determining a current minimum stress direction at the fracturing location. In one example implementation, information from tilt meters or micro-seismic tests performed on neighboring wells is used to determine geomechanical stresses at the fracturing location. In some implementations, geomechanical stresses at a plurality of possible fracturing locations are determined to find one or more locations for fracturing. Step 305 may be performed by the control unit 135 or by another computer having one or more processors and associated data storage.

The method 300 further includes initiating a first fracture at about the fracturing location in step 310. The first fracture's initiation is characterized by a first orientation line. In general, the orientation of a fracture is defined to be a vector normal to the fracture plane. In this case, the characteristic first orientation line is defined by the fracture's initiation rather than its propagation. In certain example implementations, the first fracture is substantially perpendicular to a direction of minimum stress at the fracturing location in the well bore.

The initiation of the first fracture temporarily alters the stress field in the subterranean formation, as discussed above with respect to FIGS. 2A and 2B. The duration of the alteration of the stress field may be based on factors such as the size of the first fracture, rock mechanics of the formation, the fracturing fluid, and subsequently injected proppants, if any. Due to the temporary nature of the alteration of the stress field in the formation, there is a limited amount of time for the system to initiate a second fracture at about the fracturing location before the temporary stresses alteration has dissipated below a level that will result in a subsequent fracture at the fracturing location being usefully reoriented. Therefore, in step 315 a second fracture is initiated at about the fracturing location before the temporary stresses from the first fracture have dissipated. In some implementations, the first and second fractures are initiated within 24 hours of each other. In other example implementations, the first and second fractures are initiated within four hours of each other. In still other implementations, the first and second fractures are initiated within an hour of each other.

The initiation of the second fracture is characterized by a second orientation line. The first orientation line and second orientation lines have an angular disposition to each other. The plane that the angular disposition is measured in may vary based on the fracturing tool and techniques. In some example implementations, the angular disposition is measured on a plane substantially normal to the well bore axis at the fracturing location. In some other example implementations, the angular disposition is measured on a plane substantially parallel to the well bore axis at the fracturing location.

In some example implementations, step 315 is performed using a fracturing tool 125 that is capable of fracturing at different orientations without being turned by the drive unit 130. Such a tool may be used when the downhole conveyance device 120 is coiled tubing. In other implementations, the angular disposition between the fracture initiations is cause by the drive unit 130 turning a drill string or otherwise reorienting the fracturing tool 125. In general there may be an arbitrary angular disposition between the orientation lines. In some example implementations, the angular orientation is between 45° and 135°. More specifically, in some example implementations, the angular orientation is about 90°. In still other implementations, the angular orientation is oblique.

In step 320, the method includes initiating one or more additional fractures at about the fracturing location. Each of the additional fracture initiations are characterized by an orientation line that has an angular disposition to each of the existing orientation lines of fractures induced at about the fracturing location. In some example implementations, step 320 is omitted. Step 320 may be particularly useful when fracturing coal seams or diatomite formations.

Figure 4:
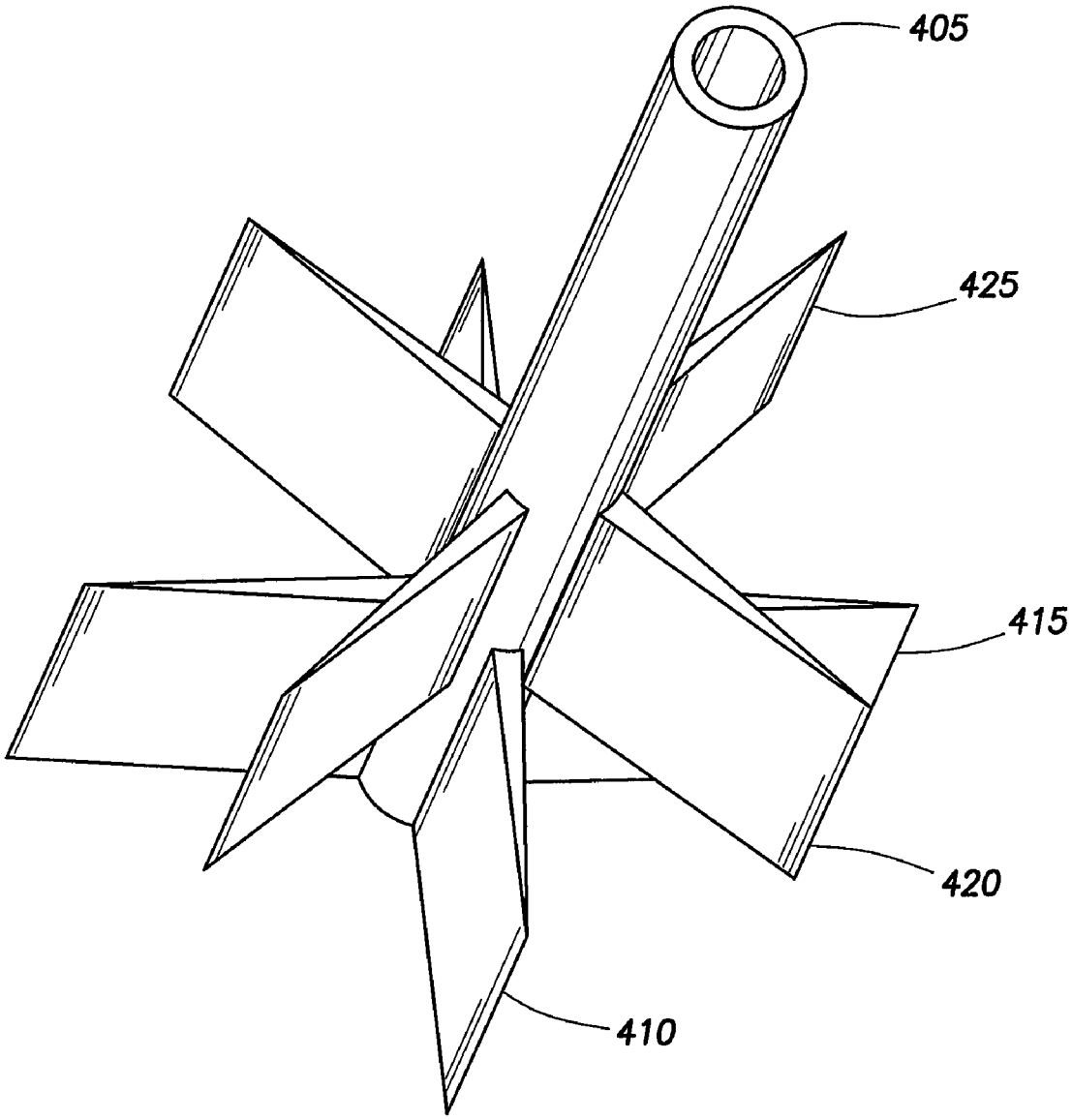
FIG. 4 is a graphical representation of a well bore and multiple fractures at different angles and fracturing locations in the well bore.

The fracturing tool 125 may be repositioned in the well bore to initiate one or more other fractures at one or more other fracturing locations in step 325. For example, steps 310, 315, and optionally 320 may be performed for one or more additional fracturing locations in the well bore. An example implementation is shown in FIG. 4. Fractures 410 and 415 are initiated at about a first fracturing location in the well bore 405. Fractures 420 and 425 are initiated at about a second fracturing location in the well bore 405. In some implementations, such as that shown in FIG. 4, the fractures are at two or more fracturing locations, such as fractures 410-425, and each have initiation orientations that angularly differ from each other. In other implementations, fractures at two or more fracturing locations have initiation orientations that are substantially angularly equal. In certain implementations, the angular orientation may be determined based on geomechanical stresses about the fracturing location.

Figure 5:
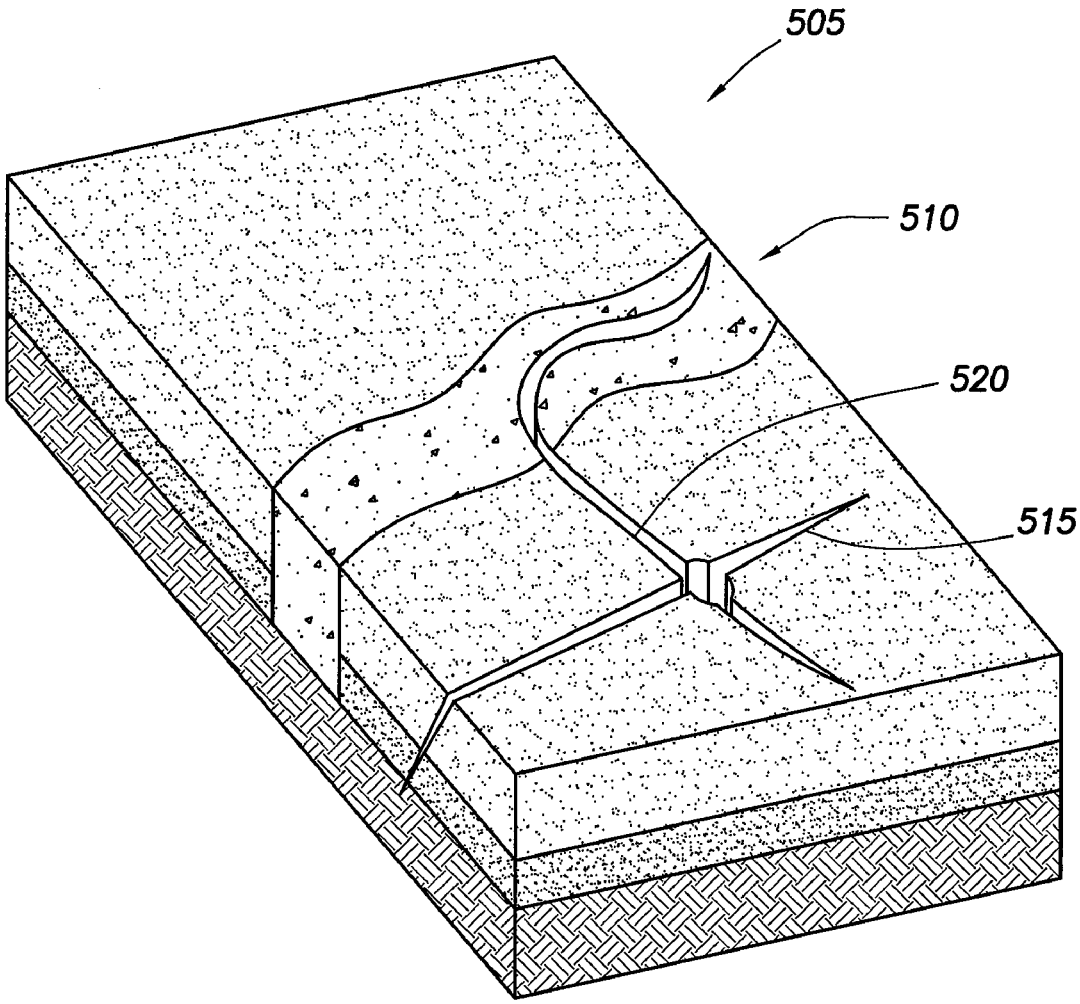
FIG. 5 is a graphical representation of a formation with a high-permeability region with two fractures.

FIG. 5 is an illustration of a formation 505 that includes a region 510 with increased permeability, relative to the other portions of formation 505 shown in the figure. When fracturing to increase the production of hydrocarbons, it is generally desirable to fracture into a region of higher permeability, such as region 510. The region of high permeability 510, however, reduces stress in the direction toward the region 510 so that a fracture will tend to extend in parallel to the region 510. In the fracturing implementation shown in FIG. 5, a first fracture 515 is induced substantially perpendicular to the direction of minimum stress. The first fracture 515 alters the stress field in the formation 505 so that a second fracture 520 can be initiated in the direction of the region 510. Once the fracture 520 reaches the region 510 it may tend to follow the region 510 due to the stress field inside the region 510. In this implementation, the first fracture 515 may be referred to as a sacrificial fracture because its main purpose was simply to temporarily alter the stress field in the formation 505, allowing the second fracture 520 to propagate into the region 510.

Figure 6:
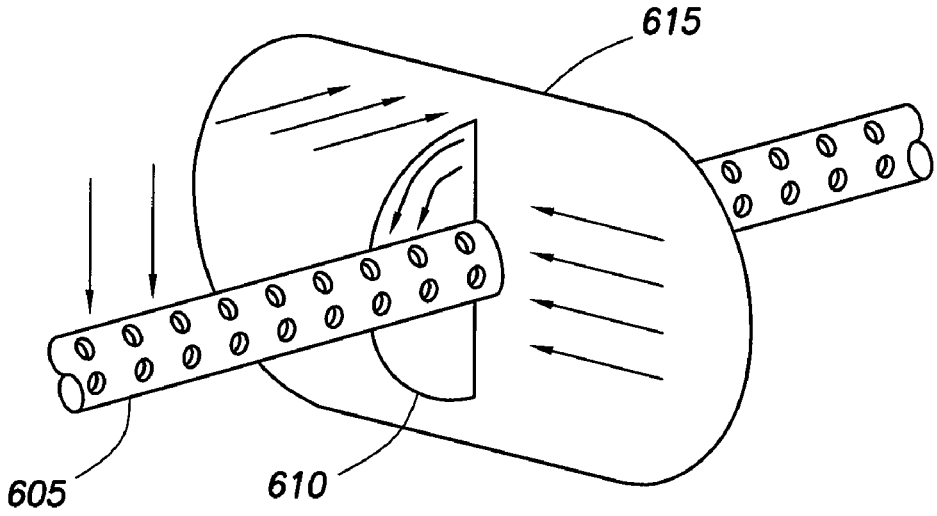
FIG. 6 is a graphical representation of drainage into a horizontal well bore fractured at different angular orientations.

FIG. 6 illustrates fluid drainage from a formation into a horizontal well bore 605 that has been fractured according to method 100. In this situation, the effective surface area for drainage into the well bore 605 is increased, relative to fracturing with only one angular orientation. In the example shown in FIG. 6, fluid flow along planes 610 and 615 are able to enter the well bore 605. In addition, flow in fracture 615 does not have to enter the well bore radially; which causes a constriction to the fluid. FIG. 6 also shows flow entering the fracture 615 in a parallel manner; which then flows through the fracture 615 in a parallel fashion into fracture 610. This scenario causes very effective flow channeling into the well bore.

Figure 7:
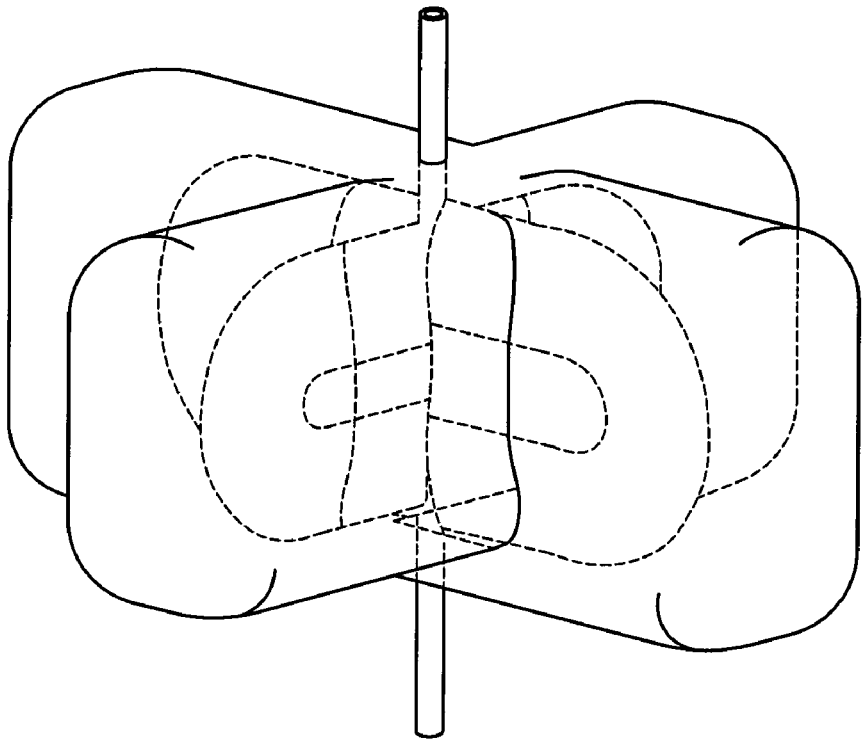
FIG. 7 is a graphical representation of the drainage of a vertical well bore fractured at different angular orientations.

In general, additional fractures, regardless of their orientation, provide more drainage into a well bore. Each fracture will drain a portion of the formation. Multiple fractures having different angular orientations, however, provide more coverage volume of the formation, as shown by the example drainage areas illustrated in FIG. 7. The increased volume of the formation drained by the multiple fractures with different orientations may cause the well to produce more fluid per unit of time.

Figure 8:
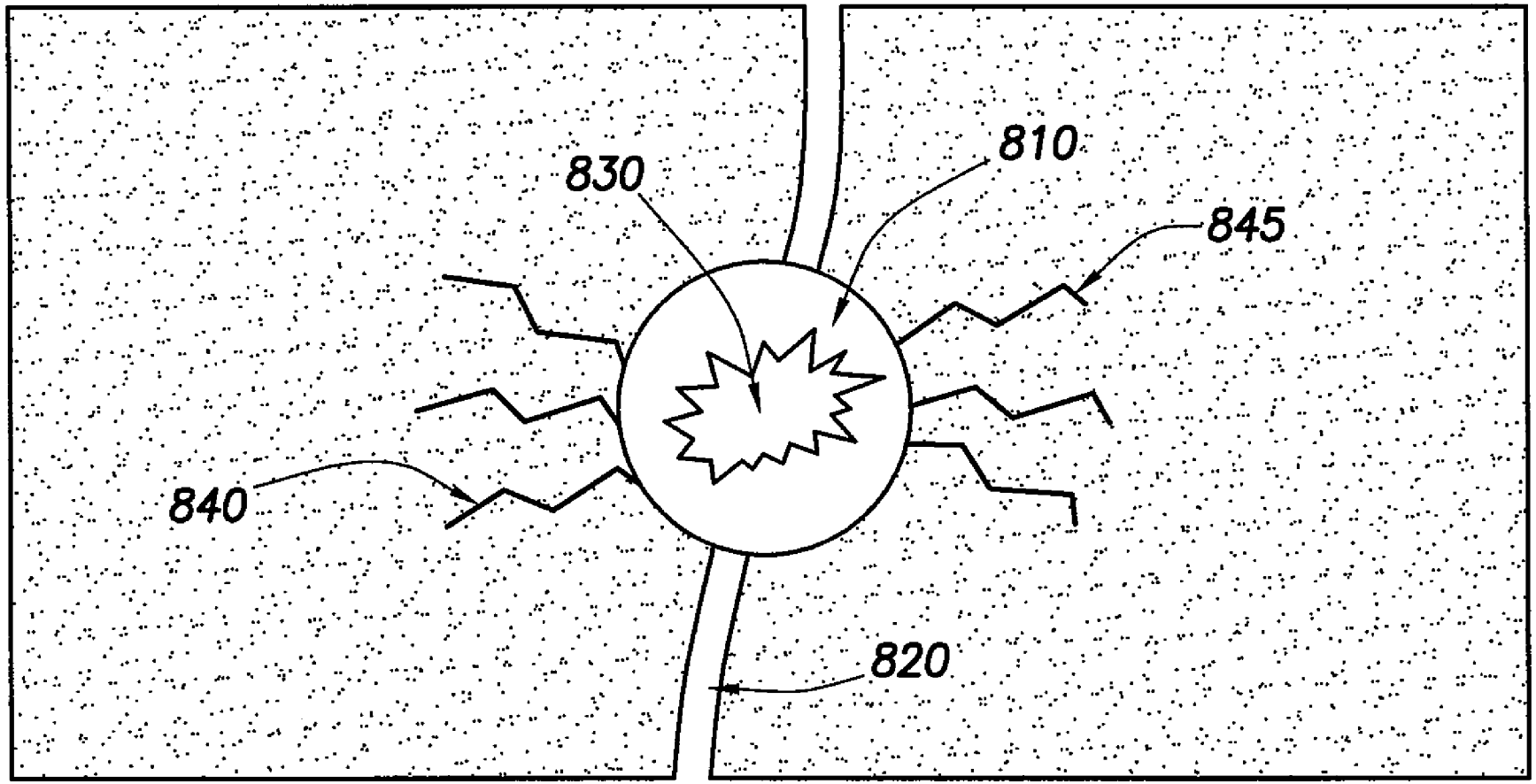
FIG. 8 is a diagram of a fracturing operation in accordance with an embodiment of the present invention.

FIG. 8 illustrates an operation in accordance with an embodiment of the present invention, where the pressure inside the well bore is communicated to a location away from the well bore by means of explosive devices or cryogenic means. As shown in the figure, a first fracture 820 is initially created from well bore 810 by a conventional or unconventional method. Shortly thereafter, an explosive or cryogenic event 830 occurs; causing the formation to be fractured as shown at 840. The pressure can be communicated to the fracture tips 845 away from the well bore by pressurizing the well bore during the explosive or cryogenic event 830. Therefore, a fracture that is substantially perpendicular to the first fracture can be created.

In one exemplary implementation the fracturing tool 125 may utilize a combustible fluid mixture such as an oxygen mixture, explosives, or other suitable material as the fracturing fluid to implement the method 300. Specifically, the fracturing tool 125 introduces a combustible fluid mixture into the region where the one or more additional fractures are to be formed. This combustible fluid mixture is then detonated immediately after pressurization thereby forming the additional fractures. In this embodiment a pump may be used to flow the combustible fluid mixture to the fracturing tool 125. The fracturing tool 125 receives the combustible fluid mixture in the tool body and may include one or more openings to deliver the combustible fluid mixture into the subterranean formation. The combustible fluid mixture may be detonated using detonators or oxidizers which are well known to those of ordinary skill in the art. As would be appreciated by those of ordinary skill in the art, with the benefit of this disclosure the fracturing tool 125 may be rotated to reorient the tool body to fracture at different orientations. For example, the tool body may rotate about 180°.

In another exemplary implementation, the fracturing tool 125 may be a StimGun™, available from Marathon Oil Company of Houston, Tex. The operation of a StimGun™ is described in detail in U.S. Pat. No. 5,775,426 which is incorporated herein by reference in its entirety. Specifically, in this exemplary implementation, the StimGun™ consists of a cylindrical sleeve of gas generating propellant which is placed over the outside of a traditional hollow perforating gun. As would be appreciated by those of ordinary skill in the art, with the benefit of this disclosure, any conventional deep penetrating or big hole shaped charge can be utilized with the StimGun™. Once the StimGun™ is placed at a desired location and orientation it may be detonated by conventional electric line, or tubing conveyed firing techniques. Once the shaped charge is detonated, the propellant sleeve is ignited within an instant thereby producing a burst of high pressure gas. The detonation is timed so as to create the additional fracture(s) before the temporary stress alteration resulting from the first fracture has dissipated. After the gas pressure in the well bore dissipates, the gas in the formation is surged into the well bore. In one exemplary implementation the operation of the StimGun™ is followed by a cryogenic fluid such as liquid Nitrogen to promote temperature fluctuations. The temperature fluctuations may lead to a rapid expansion of the formation, establishing small fractures 840 and transmitting the internal pressure to the fracture tips 845.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In addition, the terms in the claims have their plain, ordinary meaning unless otherwise explicitly and clearly defined by the patentee.

What is claimed is:

1. A method for fracturing a subterranean formation, wherein the subterranean formation comprises a well bore having an axis, the method comprising:

inducing a first fracture in the subterranean formation, wherein:

the first fracture is initiated at about a fracturing location, the initiation of the first fracture is characterized by a first orientation line, wherein a direction of the first orientation line is determined by a natural stress field in the subterranean formation;

the first fracture temporarily alters the natural stress field in the subterranean formation; and using explosives to induce a second fracture in the subterranean formation, wherein:

the second fracture is initiated at about the fracturing location, the initiation of the second fracture is characterized by a second orientation line, the first orientation line and the second orientation line have an angular disposition to each other; and the second fracture is induced in the subterranean formation using a fracture inducing device comprising:

a perforating gun;

a sleeve of gas generating propellant placed on an outside of the perforating gun; and a detonation device selected from the group consisting of an electric line and a tubing;

wherein the detonation device ignites the sleeve of gas generating propellant;

wherein the angular disposition between the first orientation line and the second orientation line is caused by repositioning the fracture inducing device before inducing the second fracture in the subterranean formation.

2. The method of claim 1, wherein the second fracture is initiated before the temporary alteration of the natural stress field in the subterranean formation has dissipated.

3. The method of claim 1, wherein the second fracture is initiated within twenty-four hours of the first fracture being initiated.

4. The method of claim 1, wherein the second fracture is initiated within four hours of the first fracture being initiated.

5. The method of claim 1, wherein the angular disposition is between 45° and 135°.

6. The method of claim 1, wherein the angular disposition is about 90°.

7. The method of claim 1, further comprising:

determining a set of geomechanical stresses at the fracturing location in the well bore;

wherein the first orientation line and second orientation line are chosen based, at least in part, on the set of geomechanical stresses.

8. The method of claim 1, wherein the first fracture is substantially perpendicular to a direction of minimum stress at the fracturing location in the well bore.

9. The method of claim 1, further comprising:

inducing a third fracture in the subterranean formation, wherein:

the third fracture is initiated at about a second fracturing location, the initiation of the third fracture is characterized by a third orientation line, and the third fracture temporarily alters a stress field in the subterranean formation; and inducing a fourth fracture in the subterranean formation, wherein:

the fourth fracture is initiated at about the second fracturing location, the initiation of the fourth fracture is characterized by a fourth orientation line, and the third orientation line and the fourth orientation line have an angular disposition to each other.

10. The method of claim 1, further comprising:

inducing at least one additional fracture, wherein:

the at least one additional fracture is initiated at about the fracturing location;

the initiation of the at least one additional fracture is characterized by an additional orientation line, and the additional orientation line differs from both the first orientation line and the second orientation line.

11. The method of claim 1, further comprising inducing a cryogenic fluid into the second fracture.

12. The method of claim 11, wherein the cryogenic fluid is liquid Nitrogen.

13. The method of claim 1, wherein the fracture inducing device is coupled to a drill string, wherein repositioning the fracture inducing device comprises rotating the drill string.

14. The method of claim 1, wherein using explosives to induce the second fracture in the subterranean formation comprises:

delivering a combustible fracturing fluid to the area where the second fracture is to be induced; and detonating the combustible fracturing fluid.

15. The method of claim 14, wherein the combustible fracturing fluid is an oxygen mixture.

16. The method of claim 14, wherein detonating the combustible fracturing fluid is conducted using one of a detonator or an oxidizer.

17. The method of claim 1, wherein the second fracture is induced in the subterranean formation using a system comprising:

a downhole conveyance selected from a group consisting of a drill string and coiled tubing, wherein the downhole conveyance is at least partially disposed in the well bore;

a drive mechanism configured to move the downhole conveyance in the well bore;

a pump coupled to the downhole conveyance to flow a combustible fluid mixture through the downhole conveyance;

a fracturing tool coupled to the downhole conveyance, the fracturing tool comprising:

a tool body to receive the combustible fluid mixture, the tool body comprising a plurality of fracturing sections, wherein each fracturing section includes at least one opening to deliver the combustible fluid mixture into the subterranean formation; and a computer configured to control the operation of the drive mechanism and the pump.

18. The system of claim 17, wherein the combustible fluid mixture is an oxygen mixture.

* * * * *